US005281101A

United States Patent [19]

Bevington

[11] Patent Number: 5,281,101

[45] Date of Patent: Jan. 25, 1994

[54] WATER SUPPLY SYSTEM AND METHOD OF OPERATION THEREOF

[75] Inventor: Jack T. Bevington, Ashland, Ohio

[73] Assignee: McNeil (Ohio) Corporation, St. Paul, Minn.

[21] Appl. No.: 907,069

[22] Filed: Jul. 1, 1992

[51] Int. Cl.[5] ..... F04B 49/06

[52] U.S. Cl. ..... 417/38; 417/44 A; 417/53; 417/543

[58] Field of Search ..... 417/38, 53, 540, 543, 417/44 A

[56] References Cited

U.S. PATENT DOCUMENTS

| | | | |
|---|---|---|---|
| 2,211,074 | 8/1940 | Raulerson | 417/543 |
| 2,359,389 | 10/1944 | Saulsberry | 417/543 |
| 2,744,543 | 5/1956 | Brady, Jr. | 92/98 R |
| 3,370,544 | 2/1968 | Thorpe, Sr. | 417/540 |
| 3,457,864 | 7/1969 | Price | 417/290 |
| 3,876,336 | 4/1975 | Nash | 417/38 |
| 4,462,758 | 7/1984 | Speed | 417/38 |
| 4,936,383 | 6/1990 | Towner et al. | 417/540 |

OTHER PUBLICATIONS

Part 11, pp. 56–57 entitled "Pressure Tanks" of The Water Systems Handbook published by The Water Systems Council, 1987.

A brochure entitled "Pressurized Diaphragm Tanks" published by F. E. Myers, Ashland, Ohio dated Jan. of 1991.

*Primary Examiner*—Edward K. Look
*Assistant Examiner*—David W. Scheuermann
*Attorney, Agent, or Firm*—Renner, Kenner, Greive, Bobak, Taylor & Weber

[57] ABSTRACT

A water supply system includes a motor operated pump (12) which provides water upon demand to a remote location via a discharge pipe (13). When the demand 5 ceases, the pump (12) continues to operate to provide water to an annular chamber (21) which is under air pressure. The annular chamber (21) is formed by a storage pipe (20) generally concentrically positioned around the discharge pipe (13). A pressure switch (17) senses the water pressure in the discharge pipe (13) and stops the pump when a first predetermined pressure level is reached. Then upon the next water demand, water is provided from that in the storage pipe (20) until a second predetermined pressure level is sensed by the switch (17) at which time the pump (12) is activated to provide water through the discharge pipe (13). An air volume control unit (45) maintains the proper air pressure in the annular chamber (21).

18 Claims, 2 Drawing Sheets

WATER SUPPLY SYSTEM AND METHOD OF OPERATION THEREOF

TECHNICAL FIELD

This invention relates to a system whereby a supply of water is maintained in a storage pipe to provide water under pressure for delivery between pump motor cycles thereby preventing rapid cycling of the pump motor to prolong the life thereof. More particularly, this invention relates to a system especially adapted for use with a submersible pump such as found in wells supplying water in the residential environment.

BACKGROUND ART

Most water supply systems include a motor driven submersible pump located in a well to supply water to a residence or remote source of demand. To avoid rapid or frequent cycling of the pump motor, as during periods of small water demands, it has been necessary to provide pressure tanks, as separate units, with such water systems. These pressure tanks are usually located above the ground, such as in the basement of a home, in the line between the pump and the demand source.

While there are many types of pressure tanks, all generally perform the function of holding a supply of water under pressure to meet small water demands without the need for the pump to cycle. For example, in a typical tank a diaphragm or bladder separates air under pressure and the water supply. As such, before the pump shuts off at the end of a demand cycle, the lower part of the tank fills with water compressing the air above the bladder at the top of the tank. Then, at the time of a small demand, such as the opening of a faucet for a few moments, the supply of water to meet that demand is provided by the tank, with the air pressure above the bladder forcing the water to the location of the demand. Only when the water in the tank is essentially depleted, either by a series of small demands or upon a large demand, is it necessary for the pump to be activated thereby prolonging the life of the pump and particularly the motor thereof.

While such tanks adequately function for their intended purpose, they are not without their deficiencies. First, they represent significant initial and maintenance costs to the system. In addition, depending on the water system involved, they can be quite sizeable, some models being over six feet tall and two feet in diameter. As such, they take up a great deal of space for the consumer and represent a sizeable shipping cost to the manufacturer. Moreover, pressure tanks in the home represent a potential safety hazard in that the internal pressure, acting against the large surface area of the tanks, creates a significant force. As such, the pressure tanks have been known to fracture or explode, especially after they structurally deteriorate and yet are still exposed to the necessary internal pressures.

Thus, the need exists for a system which can supply small demands without the need for the expensive and potentially hazardous pressure tank.

DISCLOSURE OF THE INVENTION

It is thus a primary object of the present invention to provide a water supply system, and its method of operation, which controls and prevents the rapid cycling of the pump and yet meets small water demands without the need for a separate pressure tank.

It is another object of the present invention to provide a water supply system, as above, which takes up less space than those systems utilizing a pressure tank.

It is a further object of the present invention to provide a water supply system, as above, which is less expensive to manufacture, ship and maintain.

It is an additional object of the present invention to provide a water supply system, as above, which presents no safety hazard to the consumer in that the pressurized component is not only positioned in the well, away from the user, but also does not generate the high forces which might cause the component to fracture.

These and other objects of the present invention, as well as the advantages thereof over existing prior art forms, which will become apparent from the description to follow, are accomplished by the improvements hereinafter described and claimed.

In general, the water supply system made in accordance with the present invention includes a motor operated pump which provides water through a first pipe to a remote location upon demand. A second pipe communicates with the pump and with the first pipe and holds water under pressure. The water pressure in the first pipe is sensed and upon reaching a first predetermined pressure level, the pump motor is activated, while upon reaching a second predetermined pressure level the pump motor is stopped.

The system thus operates in accordance with the method of activating the pump to move water through the first pipe when the first predetermined pressure level is sensed upon a large demand. The pump continues to operate after termination of the demand to provide water to the second pipe. After the second predetermined pressure level is sensed, the pump is stopped and thereafter water to meet the next demand from the remote location is supplied from the second pipe until the first predetermined pressure level is again sensed thereby activating the pump.

A preferred exemplary water supply system incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
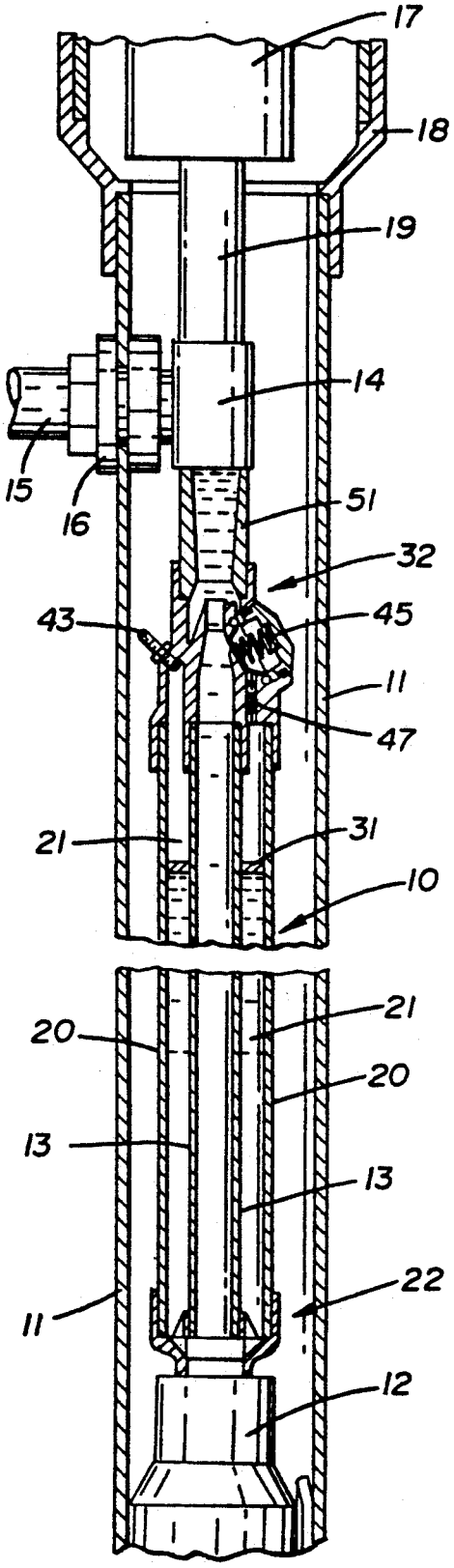
FIG. 1 is a fragmented, partially vertically sectioned view of a water supply system made in accordance with the concepts of the present invention and shown in the environment of a well and in its fully pressurized condition to supply water upon demand without the pump being activated.
Figure 2:
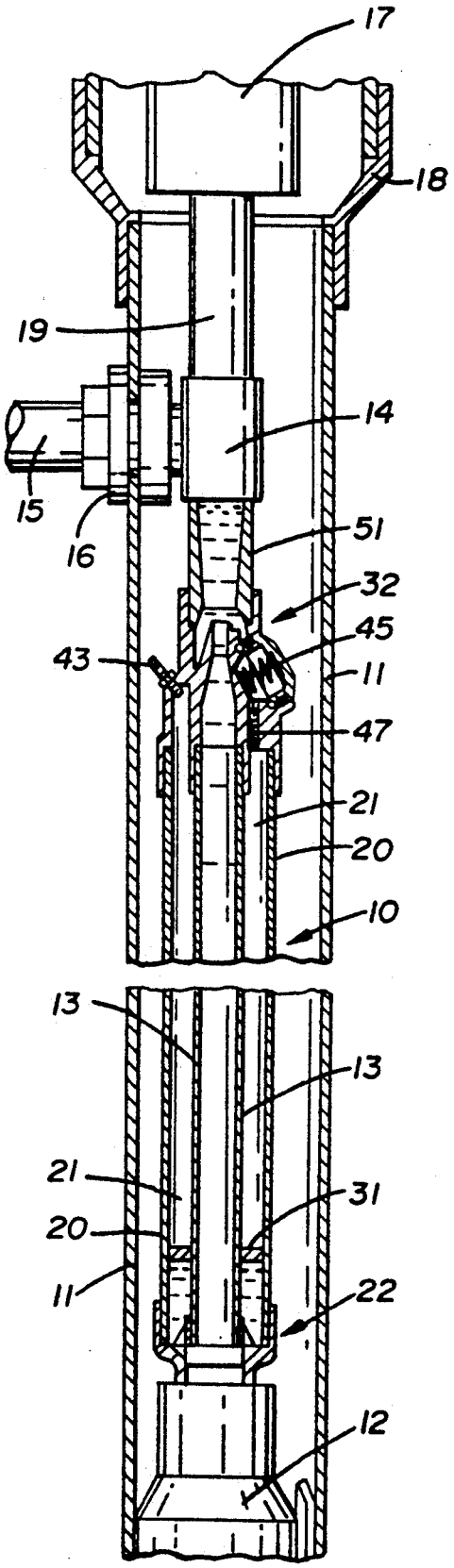
FIG. 2 is a fragmented, partially vertically sectioned view similar to FIG. 1 but showing the water supply system with its supply of water essentially depleted and the pump about to be activated.

A water supply system made in accordance with the concepts of the present invention is indicated generally by the numeral 10 in FIGS. 1 and 2 and is shown as being positioned within a well casing 11. It should be appreciated that well casing 11 may extend several hundreds of feet into the ground and thus the depictions of FIGS. 1 and 2 represent a system of significant length.

Water supply system 10 includes a conventional submersible pump 12 positioned within casing 11 near the bottom of the well. As is known to one skilled in the art, pump 12 includes a plurality of pump stages driven by a motor to draw water out of the well and transfer the same through and up a supply or discharge pipe 13 preferably made of any suitable plastic such as polyvinyl chloride (PVC). As is also well known in the art, the water within pipe 13 eventually communicates with a pitless adaptor 14 and the water is thereby provided to a demand pipe 15 through suitable fittings 16 or the like. Demand pipe 15 is thus the main line to the house or other remote area in need of water. A conventional pressure switch 17 positioned within a collar 18 at the top of casing 11 communicates via pipe 19 with the water coming from pump discharge pipe 13 and, as will be hereinafter described in detail, senses water pressure to control the operation of the motor of pump 12.

Figure 3:
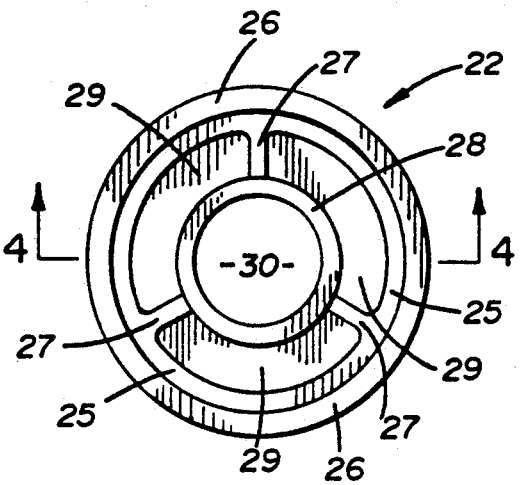
FIG. 3 is an enlarged top plan view of the bottom adaptor assembly shown in FIGS. 1 and 2.
Figure 4:
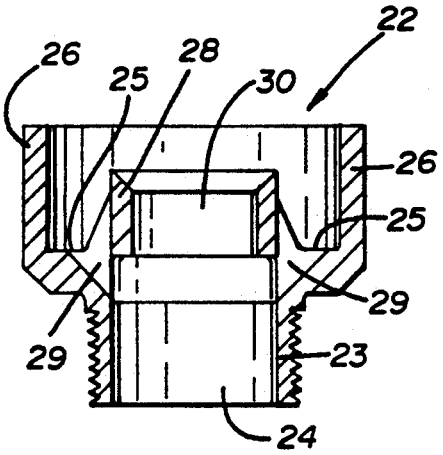
FIG. 4 is a sectional view taken substantially along line 4—4 of FIG. 3.

Water supply system 10 also includes a control and storage pipe 20 preferably also made of PVC and generally concentrically positioned around discharge pipe 13, extending upwardly through the majority of the length of casing 11. Thus, pipe 13 forms the inside wall and pipe 20 forms the outside wall of an annular chamber 21 between pipes 13 and 20. A bottom adaptor assembly, generally indicated by the numeral 22, also preferably of a PVC material, interconnects pipes 13 and 20 with pump 12. As best shown in FIGS. 3 and 4, adaptor assembly 22 is provided with an annular exteriorly threaded collar 23 which is threaded into the discharge area of pump 12 so that its interior passageway 24 communicates with the discharge from pump 12. At the top of collar 23, adaptor 22 extends radially outwardly to form an annular ledge 25 and then turns axially upwardly to form an upper annular collar 26. A plurality of evenly spaced rib members 27, preferably three spaced at 120° of each other, extend radially inwardly from the area of ledge 25 to a cylindrical hub member 28 thereby defining three openings 29. Hub member 28 forms an internal opening 30 which communicates with passageway 24. Discharge pipe 13 is aligned with hub member 28 and attached thereto as by a PVC cement, and storage pipe 20 is adapted to rest on ledge 25 within collar 26, also being attached thereto by a PVC cement. As such, discharge pipe 13 receives water from the pump discharge through passageway 24 and opening 30, and chamber 21 receives water from the pump discharge through openings 29.

In a manner to hereinafter be described, the upper portion of annular chamber 21 is provided with air under pressure to act against the water received in chamber 21 from pump 12. If desired, an annular float 31 (FIGS. 1 and 2) may be provided within chamber 21 to ride on the water therein and separate it from direct contact with the air under pressure. Float 31 would thereby serve to inhibit bubbling or foaming that might otherwise occur at the water surface and also serve to minimize air absorption by the water.

Figure 5:
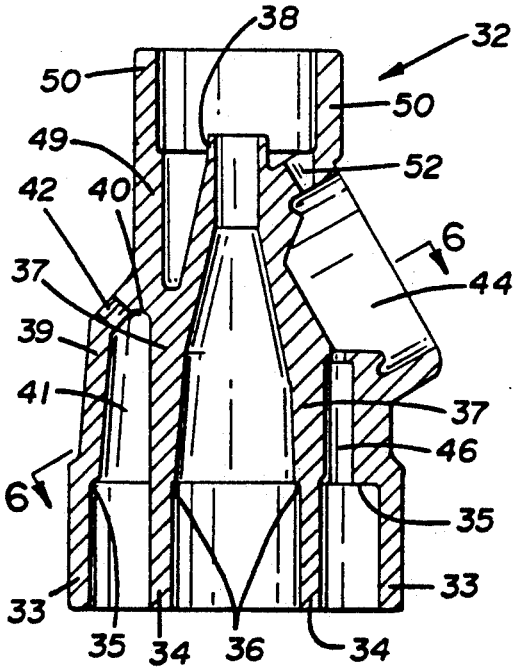
FIG. 5 is an enlarged sectional view of the upper housing assembly shown in FIGS. 1 and 2.
Figure 6:
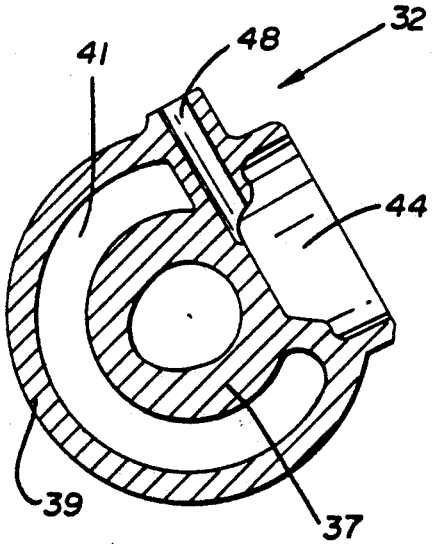
FIG. 6 is a sectional view taken substantially along line 6—6 of FIG. 5.

The top of chamber 21 is closed off by an upper housing assembly generally indicated by the numeral 32 and best shown in FIGS. 5 and 6. Housing assembly 32 can also be constructed of a PVC material and includes an outer generally cylindrical lower wall 33 and an inner generally cylindrical lower wall 34 spaced from wall 33. A radially inwardly directed generally annular shoulder 35 is formed at the top of wall 33 to rest upon the top of storage pipe 20. Similarly, a radially inwardly directed generally annular shoulder 36 is formed at the top of inner lower wall 34 to rest upon the top of discharge pipe 13. Pipes 20 and 13 can be permanently attached to housing assembly 32 as by a PVC cement or other suitable adhesive.

Integrally formed above inner lower wall 34 is a generally annular nozzle entrance wall 37 which, as shown in FIG. 5, tapers inwardly and terminates as a nozzle 38. Integrally formed above outer lower wall 33 is an intermediate outer wall 39 which, as shown in FIG. 6, extends more than 180° around the outer profile of housing assembly 32. The top of intermediate outer wall 39 extends inwardly, as at 40, to join nozzle entrance wall 37 and form an enclosed area 41 between walls 37 and 39 and above chamber 21 of pipe 20 thereby, in actuality, closing the top of chamber 21. A threaded aperture 42 is provided at at least one circumferential location through wall 39 to receive an air valve 43 (FIGS. 1 and 2) should it be desired to pressurize chambers 41 and 21 manually.

A socket 44 is formed at the ends of wall 39 to receive an air volume control unit 45 (FIGS. 1 and 2), the which will be hereinafter described. Air volume control unit 45 can be of the type generally shown in U.S. Pat. No. 2,744,543 to which reference is made for whatever details may be necessary to more fully understand the operation of the present invention. A passageway 46 is formed between socket 44 and the top of chamber 21 to receive a check valve 47 (FIGS. 1 and 2). Another passageway 48 is adapted to carry a ball type check valve (not shown) to communicate atmospheric pressure to socket 44 and unit 45 which, as will be hereinafter described, assists unit 45 in maintaining the pressure in chamber 21.

Integrally formed above intermediate outer wall 39 is an upper outer wall 49 which terminates as an annular cup 50, a portion of which is positioned above socket 44. A venturi 51 (FIGS. 1 and 2) is received within and attached to cup 50. Venturi 51 communicates with pitless adaptor 14, and thus, water from pump 12 is directed upwardly within pipe 13, through nozzle 38, through venturi 51 and into demand line 15.

In operation, chamber 21 is initially pressurized to the desired pressure preferably by introducing air through valve 43. A typical initial air pressure would be just under the predetermined low water pressure level sensed by pressure switch 17 which, as will hereinafter be described, can be about twenty psi. Thus, chamber 21 can be pressurized, for example, to about eighteen psi.

FIG. 1 shows the condition of system 10 with the pump 12 off and there being no demand. Chamber 21 has been filled by pump 12 with water to a predetermined level, with the area above float 31 in chamber 21 being under the air pressure in the top of chamber 21. This predetermined level can be established by the volume of water desired to be stored in chamber 21. Although pipes 13 and 20 are usually quite small, on the order of one inch in diameter and two and one-half inches in diameter, respectively, in deep wells a significant volume of water can be stored in chamber 21. For example, typically it is desired to store two to four gallons of water in chamber 21, such volume being sufficient to supply water for a series of small demands. If system 10 is employed in a shallow well, the diameter of pipe 20 can merely be made larger and effectively the same volume of water can be stored in chamber 21.

Upon demand, as by turning on a faucet fed by line 15, the air pressure above float 31 will force the water in chamber 21 down through openings 29 in adaptor assembly 22 and up pipe 13 to satisfy the demand. Finally, when the water in chamber 21 is nearly depleted, as shown in FIG. 2, pressure switch 17 senses this predetermined low water pressure level, previously described as being approximately twenty psi, for example, and activates pump 12 which then takes over supplying the demand. When all demand in line 15 ceases, pump 12 will continue to operate to refill chamber 21 through openings 29 of adaptor assembly 22 until the FIG. 1 water position is reached at which time pressure switch 17 will sense a predetermined high water pressure level, for example, forty psi, and will turn pump 12 off. In such a manner, by setting pressure switch 17 as desired, a small demand, or successive small demands are met by the water in chamber 21 without needlessly cycling pump 12.

In a system such as just described, it is inevitable that the initial desired air pressure above the water in chamber 21 will decrease. If float 31 is not employed, some air will be readily absorbed by the water, and even when utilizing float 31, some air will be absorbed thereby reducing the air pressure. While the desired pressure could be periodically manually restored via valve 43, air volume control unit 45 is preferably provided to automatically maintain the desired pressure. In this regard, as water moves upwardly within pipe 13 upon user demand, nozzle 38 increases the velocity thereof. As the water moves into venturi 51, the sudden drop in velocity of the water creates a vacuum which, through a passageway 52 (FIG. 5), causes a diaphragm in control unit 45 to flex thereby drawing a quantity of air into control unit 45 through passageway 48. When pump 12 stops operating, the vacuum turns to pressure permitting unit 45 to introduce air through check valve 47 into the top of chamber 21, if needed, thereby maintaining the desired pressure. The setting of a spring in unit 45 determines whether air will be introduced through check valve 47. If the pressure is more than the forty psi upper level, then no air is introduced. However, if the pressure is less than the desired upper level, the spring acting on the diaphragm will force the air into chamber 21 to maintain the desired pressure.

It should thus be evident that a water supply system constructed as described herein will accomplish the objects of the present invention and otherwise substantially improve the art.

I claim:

1. A water supply system comprising a motor operated pump, first pipe means receiving water from said pump and supplying the water to a remote location upon demand, second pipe means communicating with said pump and said first pipe means and holding water under pressure, housing means attached to said first pipe means and attached to and closing said second pipe means, said housing means including a nozzle formed therein communicating with the water in said first pipe means, and means for holding a venturi, a venturi communicating with said nozzle, and means to sense the water pressure in said first pipe means, said means to sense activating the motor of said pump when a first predetermined pressure level is detected and stopping the motor of said pump when a second predetermined pressure level is detected.

2. A water supply system according to claim 1 wherein said second pipe means is positioned generally concentrically around said first pipe means thereby forming an annulus between said first and second pipe means, said annulus holding the water under pressure.

3. A water supply system according to claim 2 further comprising means to close said annulus, and means to pressurize said annulus with air.

4. A water supply system according to claim 3 further comprising float means positioned on to of the water in said annulus thereby separating the water from the pressurized air.

5. A water supply system according to claim 1 further comprising an adaptor assembly attached to said first pipe means and said second pipe means.

6. A water supply system according to claim 5 wherein said adaptor assembly includes means defining a passageway between said pump and said first pipe means and means defining at least one passageway between said pump and said second pipe means.

7. A water supply system according to claim 6 wherein said at least one passageway also provides communication between said first pipe means and said second pipe means.

8. A water supply system according to claim 1 further comprising air valve means in said housing means to enable said second pipe means to be pressurized.

9. A water supply system comprising a motor operated pump, first pipe means receiving water from said pump and supplying the water to a remote location upon demand, second pipe means communicating with said pump and said first pipe means and holding water under pressure, housing means attached to said first pipe means and attached to and closing said second pipe means, an air volume control unit to maintain the pressure in said second pipe means, said housing means including socket means formed therein to receive said unit, and means to sense the water pressure in said first pipe means, said means to sense activating the motor of said pump when a first predetermined pressure level is detected and stopping the motor of said pump when a second predetermined pressure level is detected.

10. A water supply system according to claim 9 further comprising a valve positioned in a passageway in said housing means, said passageway communicating with said unit and said second pipe means so that said unit can supply air to said second pipe means.

11. A water supply system according to claim 10, further comprising a venturi communicating with said first pipe means, said housing having a second passageway between said venturi and said unit.

12. A water supply system according to claim 11, said housing having a third passageway communicating said unit to atmospheric pressure.

13. A method of supplying water from a source to a remote location upon demand comprising the steps of activating a pump to move water through a first pipe to a remote location upon sufficient demand, increasing the velocity of the water in the first pipe by passing it through a nozzle, continuing to operate the pump after the termination of the demand to provide water directly to a pressurized second pipe in communication with the first pipe, sensing the water pressure in the first pipe, stopping the pump when a first predetermined water pressure is sensed, supplying water to the remote location from the second pipe without activating the pump upon the next demand from the remote location, and again activating the pump when a second predetermined water pressure is sensed.

14. A method according to claim 13 further comprising the step of decreasing the velocity of the water in the first pipe by passing it through a venturi after passing it through the nozzle thereby creating a vacuum to charge a pressure control unit with a quantity of air.

15. A method according to claim 14 further comprising the step of replacing the vacuum with pressure after the step of stopping the pump to cause the pressure control unit to discharge the quantity of air into the second pipe.

16. A method according to claim 13 wherein the second pipe is positioned generally concentrically around the first pipe to form a pressurized annulus therebetween and the step of supplying water is accomplished by supplying water from the annulus.

17. A method according to claim 16 further comprising the step of providing a passageway between the pump and the annulus to accomplish the step of continuing to operate.

18. A method according to claim 17 wherein the passageway also communicates the annulus with the first pipe.

* * * * *